United States Patent [19]

Villaume

[11] 3,945,937

[45] Mar. 23, 1976

[54] METHOD FOR IMPROVING THE STABILITY OF DETERGENT BLEACH COMPOSITIONS

[75] Inventor: Frederick George Villaume, Martinsville, N.J.

[73] Assignee: American Cyanamid Company, Stamford, Conn.

[22] Filed: Apr. 2, 1974

[21] Appl. No.: 457,288

[52] U.S. Cl. ..... 252/102; 252/95; 252/99; 252/186

[51] Int. Cl.[2] ..... C11D 7/54

[58] Field of Search ..... 252/102, 95, 99, 186

[56] References Cited

UNITED STATES PATENTS

| | | | |
|---|---|---|---|
| 3,576,748 | 4/1971 | Petersson | 252/99 X |
| 3,725,289 | 4/1973 | Mouret | 252/99 X |
| 3,824,188 | 7/1974 | Loffelman et al. | 252/99 X |

*Primary Examiner*—Mayer Weinblatt
*Attorney, Agent, or Firm*—John L. Sullivan

[57] ABSTRACT

The storage stability of detergent compositions comprising an inorganic peroxygen bleaching compound, such as sodium perborate, and, as an activator therefor, a substituted halotriazine compound, such as 2,4-dichloro-6-bis(hydroxyethyl)amino-s-triazine, is markedly improved if the composition is prepared by spray-drying a water slurry of the detergent and the activator compound and then dry-blending said mixture with the inorganic peroxygen bleaching compound.

3 Claims, No Drawings

METHOD FOR IMPROVING THE STABILITY OF DETERGENT BLEACH COMPOSITIONS

This invention relates to improved detergent compositions comprising an inorganic peroxygen bleaching compound and, as an activator therefor, a substituted halotriazine compound. More particularly, the invention relates to a method for improving the stability of these detergent compositions toward loss of bleaching activity on storage.

The use of various compounds as peroxygen bleach activators has previously been disclosed. For example, see French Patent 1,583,330 (N-acyl derivatives of imidazoles, pyrazoles and triazoles), British Patent 1,046,251 (N-acyl derivatives of pyridazine, triazoles and pyrazoles). Many peroxygen bleaching compositions containing such activators have proved unsatisfactory for one or more reasons, such as inadequate bleaching at 50° to 70°C., the typical working temperature range of modern laundry washing machines, or because the activators tended to lose their effectiveness in the time interval between manufacture and actual use of the bleaching compositions, due to storage for extended periods of time under varying conditions of humidity and temperature.

In a pending application of Frank F. Loffelman and Thomas E. Brady, Ser. No. 343,313, filed Mar. 21, 1973 and assigned to the same assignee as the instant application, there is disclosed a class of compounds which are highly effective activators for peroxygen bleaching compositions, viz., substituted halotriazines represented by the formula:

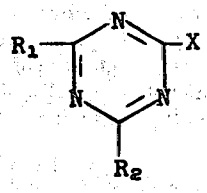

wherein X represents halogen, preferably chlorine; $R_1$ and $R_2$ individually represent halogen, hydroxy, mercapto, alkyl, alkenyl, alkoxy, alkylmercapto, aryl, aryloxy, arylmercapto, dialkoxyphosphinyl or

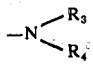

where $R_3$ and $R_4$ may be hydrogen, alkyl, cyanoalkyl, hydroxyalkyl, carboxyalkyl, chloroalkyl, alkoxyalkyl, sulfoalkyl, aryl, sulfoaryl, acylaminoaryl or carbamoylalkyl, or where $R_3$ and $R_4$ taken together may be joined to complete a heterocyclic ring selected from morpholine, piperazine and piperidine rings. In each instance where alkyl, alkenyl or alkoxy is mentioned, the term is intended to designate lower (i.e., $C_1$–$C_5$) alkyl, lower (i.e., $C_1$–$C_5$) alkenyl or lower (i.e., $C_1$–$C_5$) alkoxy.

Typical of the said class of substituted halotriazine compounds are the following:

2,4-dichloro-6-methoxy-s-triazine,
2,4-dichloro-6-di(cyanomethyl)amino-s-triazine,
2-chloro-4,6-bis(dicyanomethyl)amino-s-triazine,
2-chloro-4-methoxy-6-(dicyanomethyl)amino-s-triazine,
2-chloro-4-methoxy-6-phenoxy-s-triazine, and 2,4-dichloro-6-bis(hydroxyethyl)amino-s-triazine Further examples of the substituted halotriazine compounds and their method of preparation are disclosed in the aforementioned pending application Ser. No. 343,313.

While bleaching compositions made with the said class of substituted halotriazine activator compounds exhibit good bleaching effectiveness at relatively low temperatures of 10°C. to 70°C., and possess relatively good storage stability, nevertheless, when used in detergent compositions containing inorganic peroxygen bleaching compounds, such as sodium perborate, they tend to lose more activity on storage under varying conditions of temperature and humidity than is desirable for optimally effective commercial use.

It is, therefore, an object of this invention to provide means for substantially improving the storage stability of detergent compositions containing inorganic peroxygen bleaching compounds and the substituted halotriazine bleach activators.

In accordance with the present invention, it has now been discovered that peroxygen bleaching compositions comprising an inorganic peroxygen compound and a substituted halotriazine activator compound are stabilized against loss of activity on exposure for extended periods of time to varying degrees of temperature and humidity by coating said activator particles with detergent component by a process of spraydrying, followed by blending of the peroxygen compound therewith. Thus, it has been found that when a water slurry of the detergent and the substituted halotraizine activator is spray-dried to provide a granular material in which the activator is coated with one or more of the components of the detergent, and subsequently dry blended with the inorganic peroxygen compound, the storage stability of the activated bleaching compositions is markedly improved. This finding was surprising because it was not believed possible to expose the activator compound to the elevated temperatures necessary for effective spray-drying without hydrolytic decomposition of the activator compound. Thus, heretofore, it was believed necessary to blend both the activator compound and the peroxygen compound into the finished detergent composition.

The inorganic peroxygen bleaching compounds useful in the present invention are alkali metal perborates, percarbonates, perphosphates, persulfates, monopersulfates, and the like. Mixtures of two or more bleaching compounds can, of course, be used in combination, if desired. Sodium perborate is the preferred peroxygen bleaching compound, for economic reasons, while sodium percarbonate may be preferred for ecological reasons.

The activated bleach compositions of the invention are useful for bleach applications for various substrates including fabrics, particularly when incorporated into detergent compositions for household or commercial laundering purposes. An important property of the compositions in this regard is their ability to remove stains including food stains, such as those from coffee, tea and wine, while maintaining the purity of white in uncolored textiles.

The detergent in which the activated bleach compositions are used may be any of the conventional types, such as anionic, cationic, honionic or amphoteric. Examples of anionic detergents include the alkali metal or alkaline earth metal salts or higher alkylbenzene sulfonates, olefin sulfonates, higher alkyl sulfates and higher fatty acid monoglyceride sulfates. Typical cationic detergents include tetraalkyl ammonium salts in which one of the alkyl groups contains approximately 12 to 18 carbon atoms, such as dodecyltrimethylammonium chloride or ethyl dimethyl octadecylammonium methosulfate. Typical nonionic detergents include polyglycol ethers of alkanolamides of higher fatty acids and also polyglycol ethers of higher alkanols and higher fatty acids. Amphoteric detergents include aminofatty acids such as dimethylaminopropionic acid and iminodi-fatty acids such as methyliminodilauric acid.

In the bleaching compositions of the invention, the proportion of the activator compound to the peroxygen compound may vary widely, the peroxygen compound usually being in at least a small excess. For practical purposes, a mole ratio of activator compound to peroxygen compound of from about 1:1 to about 1:10 is suitable, the preferred ratio being between about 1:1 to 1:3. Although higher amounts of the activator may be used, such use would be uneconomical since no advantage in terms of bleaching activity would be obtained thereby. In the spray drying of detergent slurry containing activator, the amount of activator incorporated will be such that after postblending with the peroxygen compound; the detergent will contain activator and peroxygen compound in the above defined ratio.

The compositions may also contain various additives which have no adverse effect on the bleaching action, such as brighteners, enzymes, etc; other components may also be present as are conventionally used in detergent compositions including so-called "builders", representatives of which are various sodium phosphate salts, carbonates, silicates, and the like as usually encountered in the art.

The invention is practiced using conventional counter-current spray-drying techniques, which are well known to those skilled in the art; see, for example, Masters, Spray Drying, CRC Press, Cleveland, Ohio, pp. 511–518.

A detergent composition, such as a heavy duty anionic detergent is prepared using precise weighing/metering of the ingredients, mixing, homogenizing and de-aeration before spray-drying. For the spray-drying, as high a solids content as possible in the water slurry is generally used (about 50–65%) in order to give the highest powder bulk density. The spray-dryer feed ordinarily must be free of air and material that can clog the nozzle atomizer. The product is then dried in a counter-current flow drying tower at an inlet temperature of about 660°–750°F. (350°–400°C) and an outlet temperature of about 195°F.–230°F. (90°–110°C.), and a nozzle atomizing pressure in the range of 30–60 atmospheres, to provide a composition with a moisture content in the range of about 8 to 13% and a bulk density in the range of about 0.30 to 0.35 gram/cm$^3$. The dried powder leaves the base of the drying tower and is transported via a conveyor belt to an air lift. During passage on the conveyor belt, product dosing of products which would be damaged during spray-drying may be carried out. These include, for example, enzymes and the peroxygen compound, if desired.

The conditions for spray-drying will depend on the type of detergent used. Light duty detergents, for example, which are less used than heavy duty detergents (useful in dishwashers, etc.), may be spray-dried by counter-current or co-current air flow at lower temperatures. However, for the purposes of the present invention, spray drying of heavy duty detergents is of major importance.

The invention is illustrated by the following examples and tests.

EXAMPLE I

Two detergent bleaching compositions (Compositions I and II) are prepared utilizing in each instance a heavy duty detergent of approximately the following composition.

| | Wgt. % |
|---|---|
| Linear Alkyl benzene sulfonate | 20.0 |
| Sodium Metasilicate | 8.0 |
| Sodium Tripolyphosphate | 50.0 |
| Carboxymethyl Cellulose | 1.5 |
| Brightener | 0.5 |
| Sodium Sulfate | 20.0 |
| | 100.0 |

I. To 50 parts water is added 47 parts of detergent. The slurry is stirred for 10 minutes at 70°C. and 3 parts of 2,4-dichloro-6-bis(hydroxyethyl)amino-s-triazine added. The slurry is again stirred for 10 minutes at 70°C., de-aerated and spray-dried counter-currently under the following conditions:

| | |
|---|---|
| Inlet air temperature, | 350°C. |
| Outlet air temperature, | 100°C. |
| Nozzle Atomizing Pressure, | 50 atm. |

To 85 parts of the spray-dried material, having a moisture content of about 10% and a bulk density of about 0.35 gram/cc., there is then added 15 parts sodium perborate tetrahydrate by dry-blending.

II. To 80.3 parts of detergent there is dryblended 15 parts of sodium perborate tetrahydrate and 4.7 parts of 2,4-dichloro-6-bis(hydroxyethyl)amino-s-triazine (equivalent in active ingredients to Composition I above).

EVALUATION OF STORAGE STABILITY

Samples of Compositions I and II are subjected to accelerated aging by exposure thereof in open petri dishes for one week at 100°F. and 80% relative humidity.

The two aged compositions are then evaluated for their bleach activity by the following procedure.

BLEACH ACTIVITY TEST

Five-gram swatches of desired 80 × 80 cotton fabric are stained with tea as follows: Five tea bags are placed in a liter of water and boiled for five minutes. The swatches are then immersed in the tea and the boiling continued for an additional five minutes. The swatches are then removed from the tea, wrung out, dried at 200°–215°C., rinsed in cold water and dried again.

Two of the tea-stained cotton swatches are placed in a stainless steel Terg-O-Tometer, a test washing machine manufactured by U.S. Testing Company and used in the detergent industry for evaluation purposes. Forty grams of unstained cotton fabric and one liter of distilled water at 120°F. are added so as to provide a typical household washing machine water to cloth ratio of 20/1. There is then added 1.25 g. of the aged detergent bleaching composition to be tested and the Terg-O-Tometer is operated at 100 cycles per minute for 15 minutes at a temperature of 120°F. The swatches are then removed, rinsed with cold water, and dried at room temperature. As control, a test is also made wherein 1 gram of detergent, 0.19 gram of sodium perborate tetrahydrate and 0.06 gram of 2,4-dichloro-6-(hydroxyethyl)-s-triazine are added separately to the Terg-O-Tometer, in order to provide a measure of the bleaching effectiveness of the fresh (unaged) composition.

The test results show that Composition I is as effective in removing the stains as the unaged composition, whereas Composition II exhibits relatively poor stain-removing ability, thus illustrating the improving effect on the aging stability of the detergent bleach composition provided by the method of the invention.

I claim:

1. A method for the preparation of storage-stable detergent bleaching compositions containing an inorganic peroxygen bleach compound and, as an activator therefore, a substituted halotriazine compound represented by the formula:

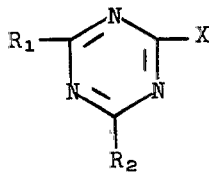

where X represents chlorine or bromine; and $R_1$ and $R_2$ individually represent chlorine, bromine, hydroxy, mercapto, lower alkyl, lower alkoxy, phenoxy, dimethoxyphosphinyl, or

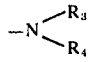

where $R_3$ and $R_4$ individually represent hydrogen, lower alkyl, lower cyanoalkyl, lower hydroxyalkyl or phenyl, or where $R_3$ and $R_4$ taken together complete a heterocyclic ring selected from morpholine, piperazine and piperidine rings; said method comprising forming an aqueous slurry of a detergent composition and said substituted halotriazine compound having a solids content in the range of about 50% to 65%, de-aerating and spray-drying said slurry using a counter-current air flow at an inlet temperature of about 350°C. to 400°C., an outlet temperature of about 90°C. to 110°C. and a nozzle atomizing pressure in the range of 30 to 60 atmospheres, to provide a composition with a moisture content in the range of about 8 to 13% and a bulk density in the range of about 0.30 to 0.35 gram/cm$^3$; dry blending said dried composition with said inorganic peroxygen bleach compound to provide in the storage-stable detergent composition a mole proportion of activator to peroxygen compound in the range of about 1:1 to 1:10.

2. The method of claim 1 wherein the substituted halotriazine compound is 2,4-dichloro-6-bis(hydroxyethyl)amino-s-triazine.

3. The method of claim 1 wherein the substituted halotriazine compound is 2-chloro-4-methoxy-6-phenoxy-s-triazine.

* * * * *